US008978756B2

(12) United States Patent
Parsche

(10) Patent No.: US 8,978,756 B2
(45) Date of Patent: Mar. 17, 2015

(54) HYDROCARBON PROCESSING APPARATUS INCLUDING RESONANT FREQUENCY TRACKING AND RELATED METHODS

(71) Applicant: Harris Corporation, Melbourne, FL (US)

(72) Inventor: Francis E. Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 306 days.

(21) Appl. No.: 13/655,626

(22) Filed: Oct. 19, 2012

(65) Prior Publication Data

US 2014/0110104 A1 Apr. 24, 2014

(51) Int. Cl.

| | |
|---|---|
| ***E21B 36/04*** | (2006.01) |
| ***E21B 43/24*** | (2006.01) |
| ***H05B 6/46*** | (2006.01) |
| ***H01Q 1/04*** | (2006.01) |
| ***H01Q 9/22*** | (2006.01) |

(52) U.S. Cl.

CPC ..... *E21B 43/24* (2013.01); *E21B 43/2401* (2013.01); *H05B 6/46* (2013.01); *H01Q 1/04* (2013.01); *H01Q 9/22* (2013.01); *H05B 2214/03* (2013.01)

USPC ..... 166/248; 166/60; 166/242.1; 166/302

(58) Field of Classification Search

USPC ..... 166/248, 66, 60, 272.1, 247, 302, 369; 219/635, 639, 663, 665, 666; 392/301

See application file for complete search history.

(56) References Cited

U.S. PATENT DOCUMENTS

| | | | | |
|---|---|---|---|---|
| 2,757,738 | A * | 8/1956 | Ritchey | 166/248 |
| 4,140,179 | A * | 2/1979 | Kasevich et al. | 166/248 |
| 4,373,581 | A | 2/1983 | Toellner | |
| RE32,913 | E * | 4/1989 | Clark | 324/338 |
| 5,199,488 | A * | 4/1993 | Kasevich et al. | 166/248 |
| 5,621,844 | A * | 4/1997 | Bridges | 392/301 |
| 6,060,889 | A * | 5/2000 | Hocker | 324/667 |
| 6,189,611 | B1 * | 2/2001 | Kasevich | 166/248 |
| 7,091,460 | B2 | 8/2006 | Kinzer | |
| 7,109,457 | B2 | 9/2006 | Kinzer | |
| 7,115,847 | B2 | 10/2006 | Kinzer | |
| 7,312,428 | B2 | 12/2007 | Kinzer | |
| 7,441,597 | B2 | 10/2008 | Kasevich et al. | |
| 7,964,289 | B2 | 6/2011 | Takai et al. | |
| 7,964,413 | B2 | 6/2011 | Macioszek et al. | |
| 7,964,614 | B2 | 6/2011 | Ridker et al. | |
| 7,966,132 | B2 | 6/2011 | Lewis et al. | |

(Continued)

FOREIGN PATENT DOCUMENTS

WO 2013028752 2/2013

*Primary Examiner* — Jennifer H Gay

(74) *Attorney, Agent, or Firm* — Allen, Dyer, Doppelt, Milbrath & Gilchrist, P.A.

(57) ABSTRACT

A device for processing hydrocarbon resources in a subterranean formation having a laterally extending wellbore therein may include a radio frequency (RF) antenna configured to be positioned within the laterally extending wellbore, and at least one feedback conductor configured to be positioned along the laterally extending wellbore. The device may also include an RF circuit configured to supply RF power to the hydrocarbon resources via the RF antenna. The RF circuit may be configured to supply the RF power at a frequency tracking a resonant frequency of the RF antenna and the RF circuit and based upon the at least one feedback conductor.

24 Claims, 4 Drawing Sheets

(56) References Cited

U.S. PATENT DOCUMENTS

| | | | | |
|---|---|---|---|---|
| 8,646,527 | B2 * | 2/2014 | Trautman et al. | 166/272.1 |
| 8,695,702 | B2 * | 4/2014 | Parsche | 166/248 |
| 8,772,683 | B2 * | 7/2014 | Parsche | 219/618 |
| 8,847,711 | B2 * | 9/2014 | Wright et al. | 333/243 |
| 2003/0131994 | A1 * | 7/2003 | Vinegar et al. | 166/256 |
| 2004/0066194 | A1 * | 4/2004 | Slade et al. | 324/318 |
| 2006/0283598 | A1 * | 12/2006 | Kasevich | 166/302 |
| 2009/0283257 | A1 | 11/2009 | Becker | |
| 2010/0065265 | A1 * | 3/2010 | Kasevich | 166/248 |
| 2010/0078163 | A1 | 4/2010 | Banerjee et al. | |
| 2010/0294489 | A1 | 11/2010 | Dreher, Jr. et al. | |
| 2011/0309990 | A1 * | 12/2011 | Parsche | 343/820 |
| 2012/0067572 | A1 * | 3/2012 | Trautman et al. | 166/272.3 |
| 2012/0067580 | A1 * | 3/2012 | Parsche | 166/302 |
| 2012/0125607 | A1 | 5/2012 | Parsche | |
| 2012/0125608 | A1 | 5/2012 | Parsche | |
| 2012/0125609 | A1 | 5/2012 | Parsche | |
| 2012/0267095 | A1 * | 10/2012 | Dreher et al. | 166/248 |
| 2013/0048277 | A1 * | 2/2013 | Parsche et al. | 166/272.1 |
| 2013/0048278 | A1 * | 2/2013 | Parsche et al. | 166/272.3 |
| 2013/0048297 | A1 * | 2/2013 | Parsche et al. | 166/369 |
| 2013/0284430 | A1 * | 10/2013 | Parsche | 166/248 |
| 2014/0014316 | A1 * | 1/2014 | Blue et al. | 166/61 |
| 2014/0020908 | A1 * | 1/2014 | Wright et al. | 166/378 |
| 2014/0110104 | A1 * | 4/2014 | Parsche | 166/248 |
| 2014/0151028 | A1 * | 6/2014 | Parsche | 166/248 |
| 2014/0224472 | A1 * | 8/2014 | Parsche | 166/60 |
| 2014/0262222 | A1 * | 9/2014 | Wright et al. | 166/248 |
| 2014/0262223 | A1 * | 9/2014 | Wright et al. | 166/248 |
| 2014/0262224 | A1 * | 9/2014 | Ayers et al. | 166/248 |

* cited by examiner

HYDROCARBON PROCESSING APPARATUS INCLUDING RESONANT FREQUENCY TRACKING AND RELATED METHODS

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294489 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to physical system limitations or a failed start-up, to extract oil using RF assisted SAGD may lead to significant heat loss to the adjacent soil, significant RF energy losses from the RF transmission line, excessive consumption of steam, and a high cost for recovery. Significant water resources are also typically used to recover oil using SAGD which impacts the environment. Limited water resources may also limit oil recovery. SAGD is also not an available process in permafrost regions, for example.

SUMMARY OF THE INVENTION

In view of the foregoing background, it is therefore an object of the present invention to more efficiently recover hydrocarbon resources from a subterranean formation, and while potentially using less energy and providing faster recovery of the hydrocarbons.

These and other objects, features, and advantages in accordance with the present invention are provided by an apparatus for processing hydrocarbon resources in a subterranean formation having a laterally extending wellbore therein and including a radio frequency (RF) antenna configured to be positioned within the laterally extending wellbore, and at least one feedback conductor configured to be positioned along the laterally extending wellbore. The apparatus also includes an RF circuit configured to supply RF power to the hydrocarbon resource via the RF antenna. The RF circuit is configured to supply the RF power at a frequency tracking a resonant frequency of the RF antenna and the RF circuit and based upon the at least one feedback conductor. Accordingly, the hydrocarbon resource is heated in the subterranean formation using a resonant frequency of the RF antenna, and the RF circuit, which advantageously may increase hydrocarbon recovery efficiency, and thus reduce overall production times.

The RF circuit may include an RF transmission line coupled to the RF antenna. The RF antenna may include first and second spaced apart conductive sleeves extending within the laterally extending wellbore in end-to-end relation and defining an antenna feedpoint therebetween, for example. The RF transmission line may have a distal end coupled to the antenna feedpoint.

The at least one feedback conductor may include a pair coupled together at distal ends to define a feedback loop. The feedback loop may be positioned adjacent the antenna feedpoint, for example. The RF transmission line may extend within the first conductive sleeve in some embodiments.

The RF circuit may include a power source and an RF amplifier coupled thereto. The RF amplifier may include at least one output coupled to the transmission line, and at least one input coupled to the at least one feedback conductor, for example. The RF transmission line may include a coaxial RF transmission line, for example.

A method aspect is directed to a method of processing hydrocarbon resources in a subterranean formation having a laterally extending wellbore therein, an RF antenna positioned within the laterally extending wellbore, and at least one feedback conductor positioned along the laterally extending wellbore. The method includes operating an RF circuit to supply RF power to the hydrocarbon resource via the RF antenna, and to supply the RF power at a frequency tracking a resonant frequency of the RF antenna and the RF circuit and based upon the at least one feedback conductor.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
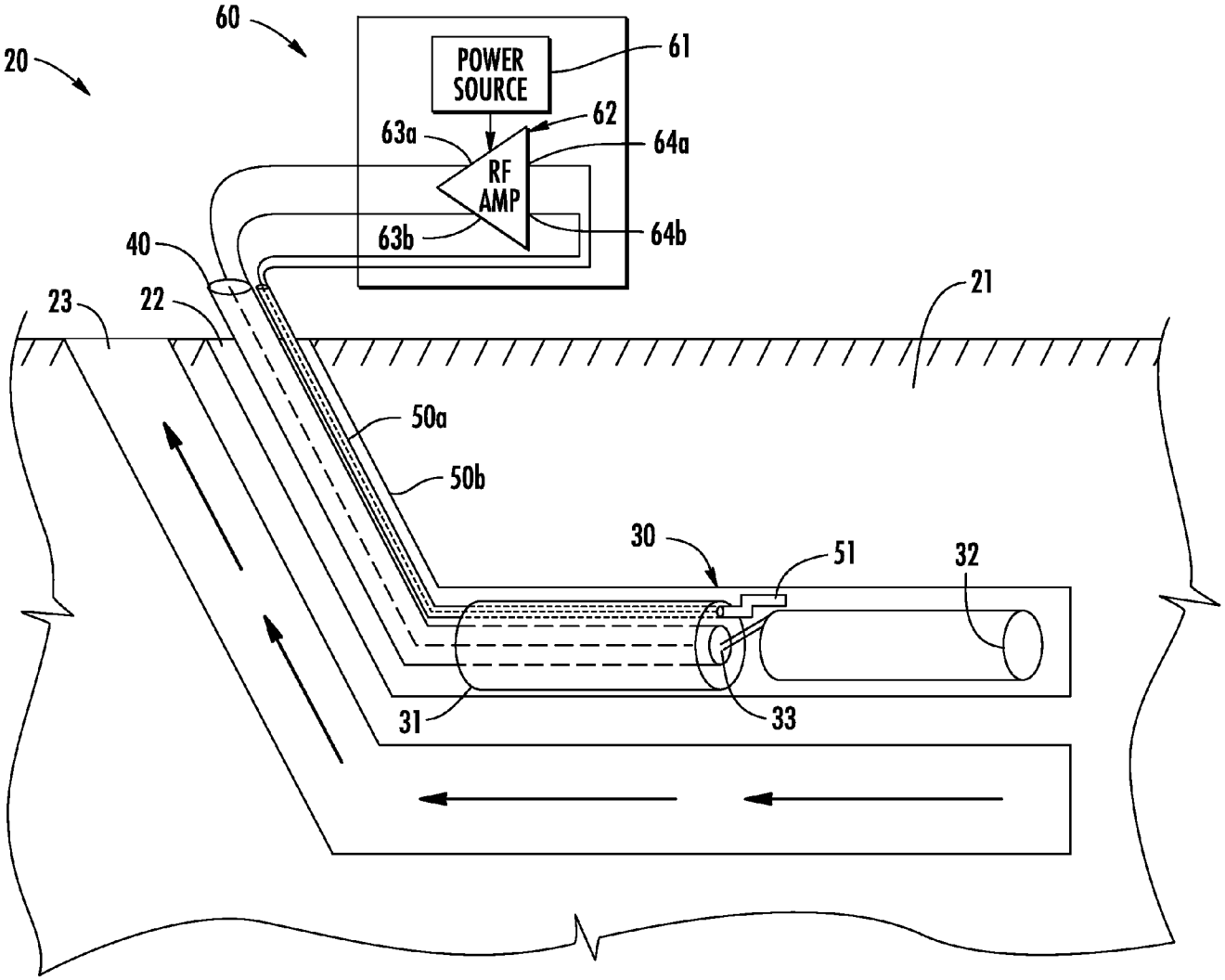
FIG. 1 is a schematic diagram of a hydrocarbon resource bearing subterranean formation including an apparatus for processing the hydrocarbon resource in accordance with the present invention.

Referring initially to FIG. 1, an apparatus 20 for processing hydrocarbon resources in a subterranean formation 21 having a laterally extending wellbore 22 therein is illustrated. The laterally extending wellbore 22 may be in the form of an injector well, for example. The subterranean formation 21 may include a second laterally extending wellbore 23, which may be in the form of a producer well, and may be positioned below the laterally extending wellbore 22. As will be appreciated by those skilled in the art, the hydrocarbon resource may be recovered from the producer well, for example, for hydrocarbon recovery using steam assisted gravity drainage (SAGD). Of course, other gravity drainage based hydrocarbon recovery techniques may be used, and a second laterally extending wellbore 23 may not be included in yet other embodiments.

The apparatus 20 includes an RF antenna 30 positioned within the laterally extending wellbore 22. The RF antenna 30 illustratively includes first and second spaced apart conductive sleeves 31, 32 extending within the laterally extending wellbore 22 in end-to-end relation and defining an antenna feedpoint 33 therebetween. More particularly, the first and second spaced apart conductive sleeves 31, 32 are positioned adjacent a payzone of the subterranean formation 21, or, in other words, positioned so that RF power radiating therefrom heats the hydrocarbon resources. As will be appreciated by those skilled in the art, the first and second spaced apart conductive sleeves 31, 32 define a sleeve dipole antenna or an inset-feed dipole. Of course the RF antenna 30 may be another type of antenna, for example, a folded dipole, loop, or a helix. A dipole antenna may be a preferred antenna type though for installation into the subterranean formation 21, as the dipole linear shape more easily fits into a wellbore.

The apparatus 20 illustratively includes an RF circuit 60, that, in turn, includes an RF transmission line 40 coupled to the RF antenna 30. The RF transmission line 40 has a distal end coupled to the antenna feedpoint 33. The RF transmission line 40 illustratively extends within the first conductive sleeve 31. The RF transmission line 40 may be in the form of a coaxial RF transmission line, for example. The RF transmission line 40 may in embodied in other forms, as will be appreciated by those skilled in the art.

The apparatus 20 further includes a pair of feedback conductors 50*a*, 50*b* positioned along the laterally extending wellbore 22. As will be appreciated by those skilled in the art, the pair of feedback conductors 50*a*, 50*b* may be positioned with the transmission line 40 within the laterally extending wellbore 22, or may be positioned outside of the laterally extending wellbore or in another adjacent laterally extending wellbore, for example. The pair of feedback conductors 50*a*, 50*b* may be in the form of inner and outer conductors of a coaxial cable, for example, which may be shielded to reduce an amount of RF power lost to undesirable locations of the subterranean formation 21. If, for example, the pair of feedback conductors 50*a*, 50*b* is in the form of inner and outer conductors of coaxial cable, it may be conductively bonded to an outer conductor of the transmission line 40 when it is in the form of a coaxial transmission line.

The pair of feedback conductors 50*a*, 50*b* is coupled together at distal ends thereof to define a feedback loop 51. While the feedback loop 51 is illustratively shaped as a rectangle, the feedback loop may be any shape. Moreover, the feedback loop 51 may be defined by a torroidal winding around the RF antenna 30, as will be appreciated by those skilled in the art. The feedback loop 51 may be positioned adjacent the feedpoint 33. In other embodiments, the feedback loop 51 may be positioned anywhere along the first and second spaced apart conductive sleeves 31, 32.

Since an electric current along a straight line produces a magnetic field, a curling magnetic near field surrounds dipole type antennas according to Amperes Law. In some embodiments the feedback loop 51 may couple to that curling magnetic near field. The electromotive force forming in the closed circuit of feedback loop 51 is based upon, and may be proportional to, the time rate of change of the magnetic flux passing through loop, according to Faraday's Law. Thus a loop can couple to a dipole according to electromagnetic induction. Of course, the feedback loop 51 may couple by other coupling techniques, such as, for example, electric fields or displacement currents. The feedback loop 51 may take other forms to enhance the coupling so the feedback loop may be a dipole, helical winding, toroidal winding, plate, cylinder, etc., depending on the form of the RF antenna 30. It may be preferential that the feedback loop 51 not be resonant itself, in which case the feedback loop 51 may be operated below its natural resonance frequency. This may be accomplished relatively easily as the heating antenna may be much larger physically than the feedback loop.

The RE circuit 60 is configured to supply RF power to the hydrocarbon resources via the RF antenna 30. The RF circuit 60 may be positioned above the subterranean formation 21, for example. The RF circuit 60 includes a power source 61 and an RF amplifier 62 coupled thereto. The RF amplifier 62 includes a pair of outputs 63*a*, 63*b* coupled to the RF transmission line 40. More particularly, the pair of outputs 63*a*, 63*b* is illustratively coupled to the inner and outer conductors of the RF transmission line 40 when it is in the form of a coaxial RF transmission line. The RF amplifier 62 also includes a pair of inputs 64*a*, 64*b* that are coupled to the pair of feedback conductors 50*a*, 50*b*.

The RF circuit 60 is configured to supply the RF power at a frequency tracking a resonant frequency of the RF antenna 30 and the RF circuit 60. The tracked frequency is advantageously based upon the pair of feedback conductors 50*a*, 50*b*. The tracked resonant frequency may be based upon the fundamental resonant frequency of the RF antenna 30, and/or a harmonic resonant frequency of the RF antenna.

Figure 2:
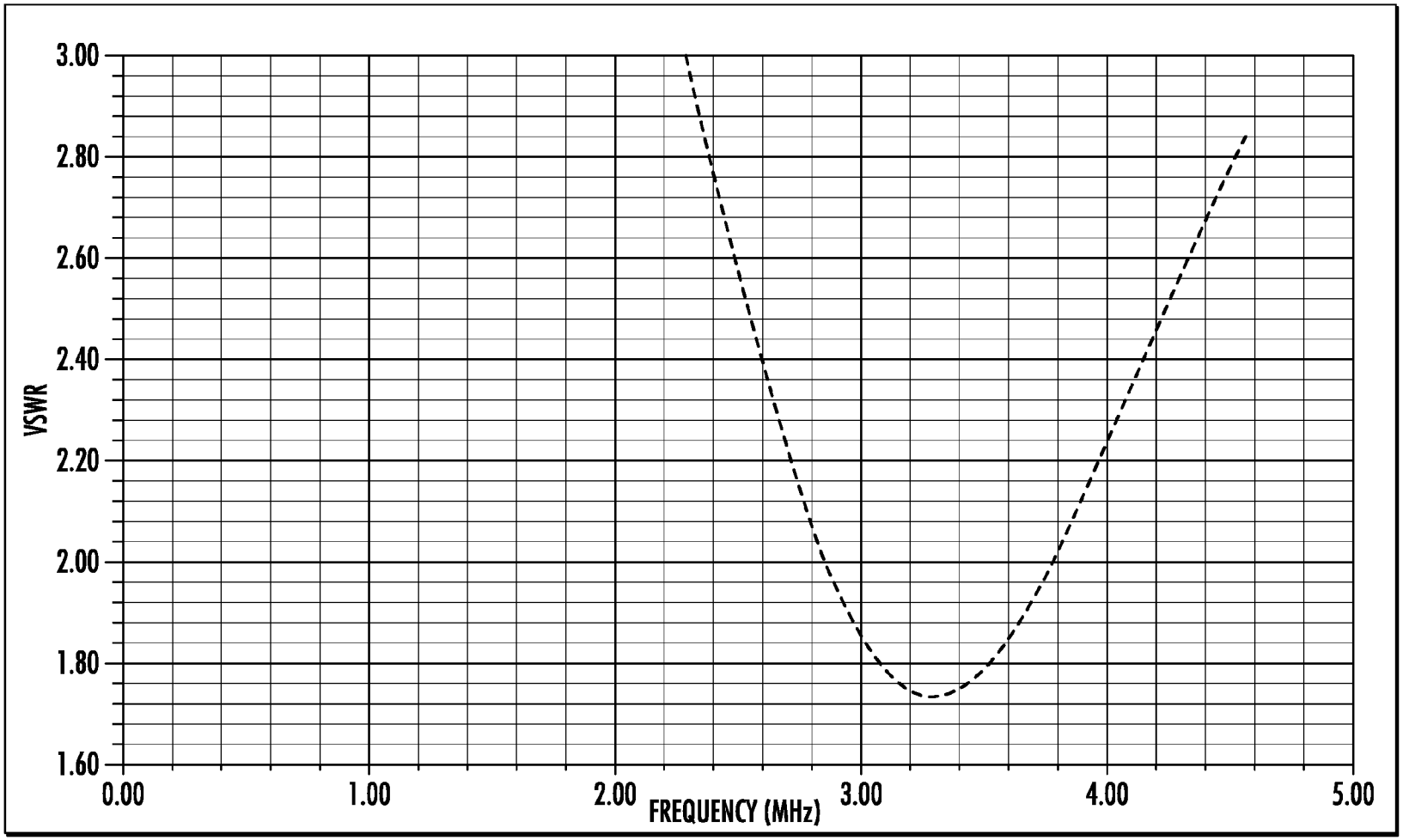
FIG. 2 is frequency versus voltage standing wave ratio plot for a given relative permittivity of the subterranean formation.
Figure 3:
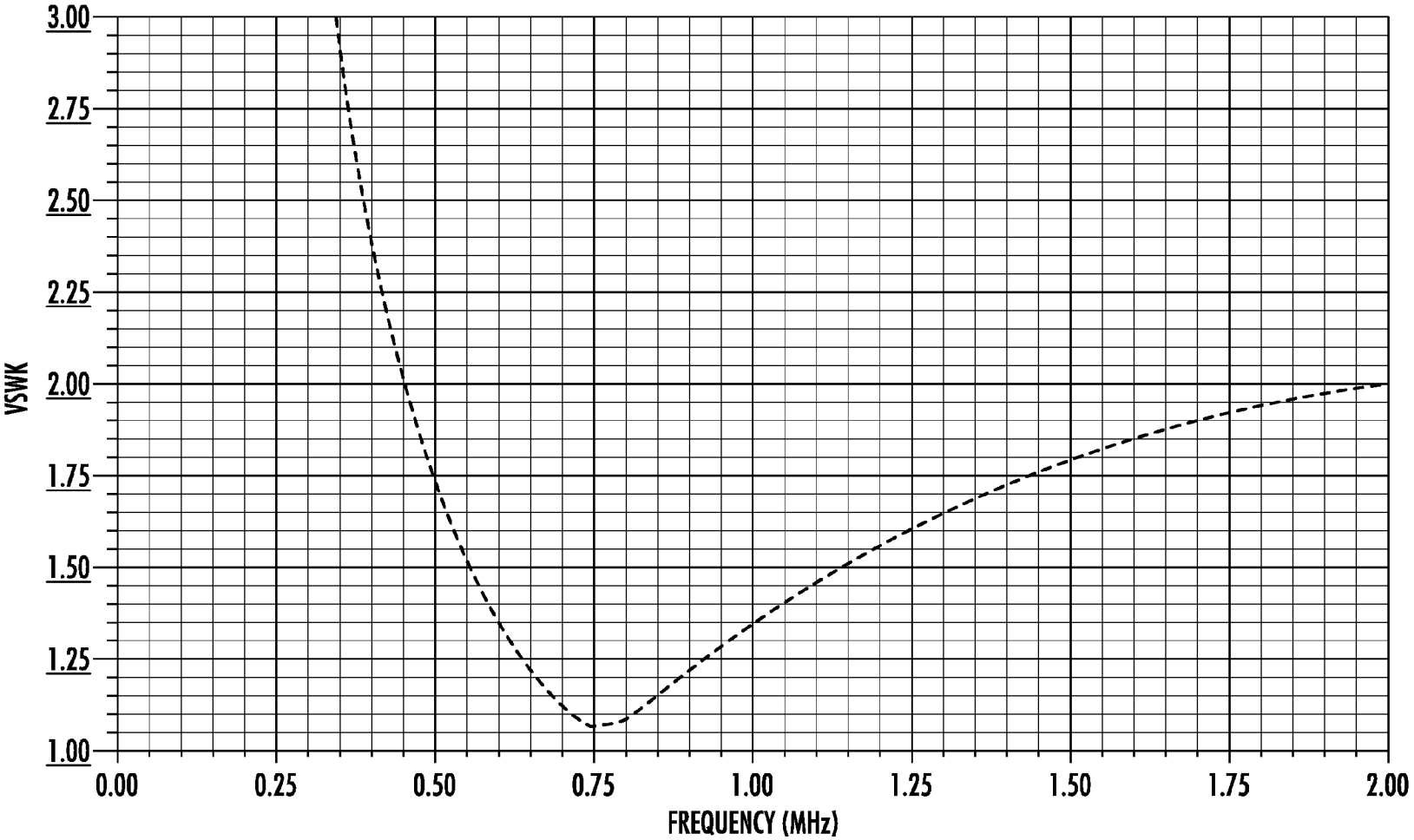
FIG. 3 is frequency versus voltage standing wave ratio plot for another relative permittivity of the subterranean formation.
Figure 4:
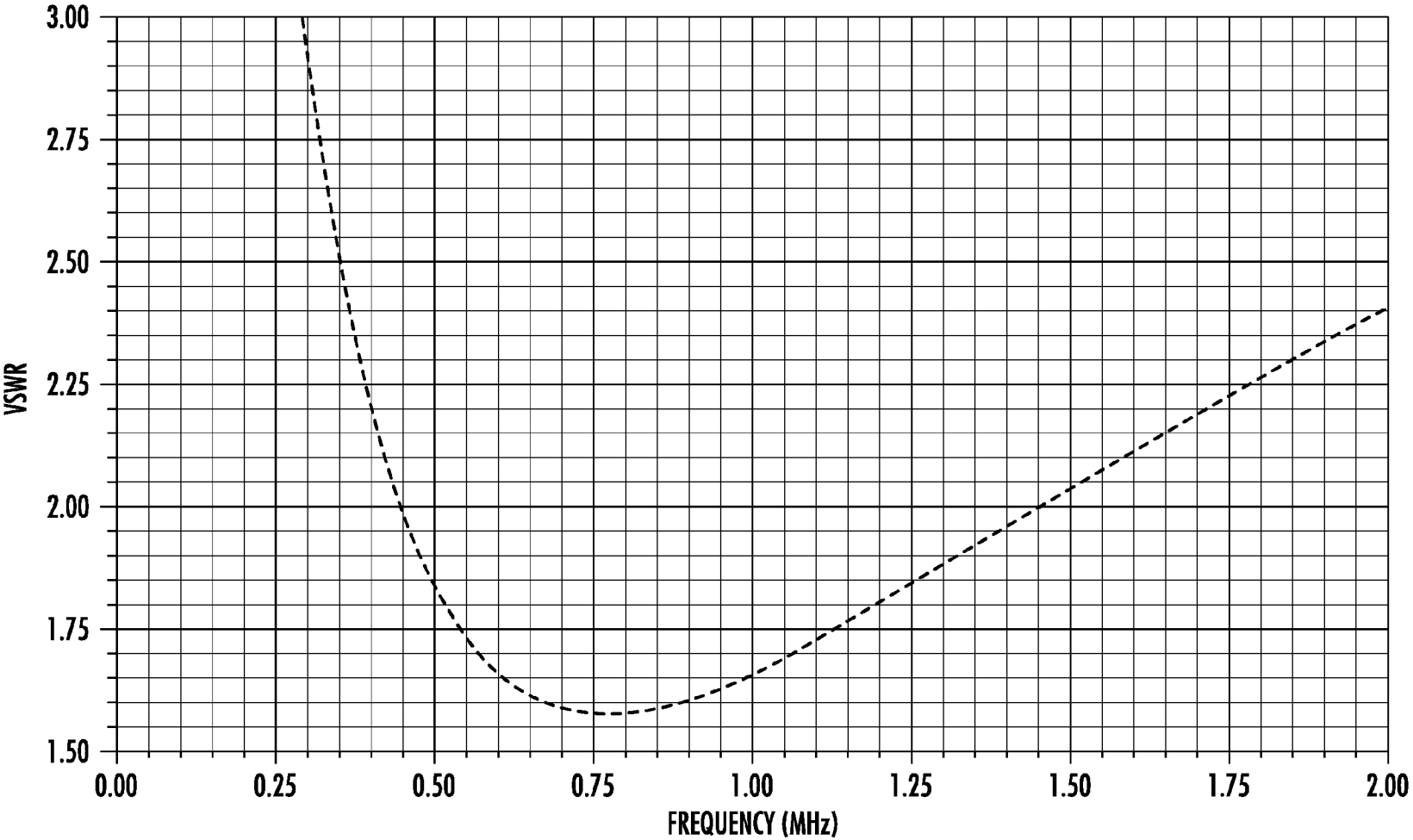
FIG. 4 is frequency versus voltage standing wave ratio plot for yet another relative permittivity of the subterranean formation.

Referring now additionally to the graphs in FIGS. 2-4, as will be appreciated by those skilled in the art, the resonant frequency of an RF antenna shifts during heating, for example, when RF power is supplied to the RF antenna. The plots in FIGS. 2-4 correspond to a decreased relative permittivity and conductivity, which is indicative of a subterranean formation being heated. Illustratively, the plots in FIG. 2 illustrate an initial resonant frequency between 3 and 4 MHz for a payzone relative permittivity of 12 and a conductivity of 0.004 mhos/meter. The graph in FIG. 3 illustrates, at a later time, a resonant frequency of about 0.75 MHz for a relative permittivity of 6 and a conductivity of 0.002 mhos/meter, for example, after heating. The graph in FIG. 4 illustrates resonant frequency of about 0.75 MHz for a relative permittivity of 3 and a conductivity of 0.001 mhos/meter, for example, after further heating.

Thus, in accordance with the behavior noted above, the resonant frequency of the RF antenna 30, and RF circuit 60 shifts when RF power is supplied to the RF antenna, and thus heats the hydrocarbon resources. Additionally, the resistance of the RF antenna 30, the RF transmission line 40, and the RF amplifier 62 also shifts when RF power is supplied to the RF antenna to heat the hydrocarbon resource.

For example, to heat hydrocarbon resources, it may be desirable to supply 5 megawatts over 900 meters through a 0.3 meter outer diameter RF transmission line in the form of a coaxial RF transmission line to an RF antenna. The RF antenna, an energy transducer, for example, has a varying electrical impedance because of the changing electrical characteristics of the oil sands of the subterranean formation 21 as heating progresses. In particular, the phase and location of the payzone connate water may change as the heating progresses.

If, for example, the RF amplifier 62 does not track the resonant frequency of the antenna, increasing reflections, voltage standing wave ratio (VSWR), power factor, and cable ringing may make RF heating, by supplying RF power, increasingly difficult due to physical limitations of the RF transmission line rating versus size, for example. For example, the RF transmission line may burn up or arc, or the RF energy may simply not reach the distal end. Indeed, it may be desirable to maintain or reduce the VSWR of the RF antenna to address the physical limitations of the RF transmission line, as VSWR greatly increases line losses. Accordingly, it may be desirable to adjust the power factor to accommodate for such limitations and losses.

To address the shifting resonant frequency and address the above-noted physical limitations, the feedback look 51 advantageously senses the resonant frequency of the RF antenna 30, and the RF circuit 60. A feedback signal from the feedback loop 51 is amplified by the RF amplifier 62. The RF antenna 30 acts as a tank circuit of a power oscillator, for example, as oscillations build up and track the resonant frequency of the RF antenna 30. The power oscillator that is formed may be partially akin to an Armstrong type oscillator, with the feedback loop 51 corresponding to the tickler coil, and the RF antenna 30 akin to the resonant circuit. A dipole type RF antenna 30 has a quadratic impedance response equivalent to capacitor, and inductor, and a resistor in series. As will be appreciated by those skilled in the art, the efficiency and feedback are typically the highest at the resonant frequency.

Additionally, the RF power through the RF antenna 30 creates a circular magnetic near field around the first and second spaced apart conductive sleeves 31, 32 according to Amperes Law. As will be appreciated by those skilled in the art, conceptually, the RF antenna 30 may be thought of as a transformer primary, and the pair of feedback conductors 50*a*, 50*b* defining feedback loop 51 may be thought of a transformer secondary. The magnetic field is the mechanism for coupling RF antenna 30, i.e., a dipole antenna, to the feedback loop 51. A linear electric conductor passing through a toroidal winding may be akin to 1 turn on the toroidal winding. Loose coupling between the RF antenna 30 and the feedback loop 51 may be beneficial to reduce pulling the resonance of oscillation away from the natural resonance of the RF antenna.

A filter (not shown) may be included at the input to the RF amplifier 62 to select at which resonance of the apparatus 20 as a whole oscillates. Dipole type antennas, for example, have harmonic resonances at integer multiples of the fundamental resonance frequency. It may thus be possible that oscillation at a harmonic rather than a fundamental resonance may be preferred as both simulation and field testing have shown increased antenna resistance at some harmonic frequencies. Additionally, standing wave type heating hotspots have not generally occurred underground when heating at the harmonics. Both electric and magnetic fields have heating effects underground. Heating at antenna current minima may occur by electric fields (capacitive coupling, displacement current, dielectric heating). At antenna current maximas, heating may occur by magnetic fields (inductive coupling, eddy currents, etc.).

Accordingly, the hydrocarbon resource is heated in the subterranean formation using a resonant frequency of the RF antenna 30, and the RF circuit 60. In other words, the RF antenna 30 is tuned, via the feedback conductors 50*a*, 50*b*, and more particularly, via the feedback loop 51, to its resonant frequency at any given point in time, even as the resonant frequency changes. Thus, an increased amount of power is transferred from the power source 61 to the RF antenna 30. This may advantageously increase hydrocarbon recovery efficiency by reducing the amount of RF energy used, and thus reduce overall production times.

A method aspect is directed to a method of processing hydrocarbon resources in a subterranean formation 21 having a laterally extending wellbore 22 therein, an RF antenna 30 positioned within the laterally extending wellbore, and at least one feedback conductor 50 positioned along the laterally extending wellbore. The method includes operating an RE circuit 60 to supply RF power to the hydrocarbon resource via the RF antenna 30 and to supply the RF power at a frequency tracking a resonant frequency of the RF antenna and the RF circuit and based upon the at least one feedback conductor 50.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An apparatus for processing hydrocarbon resources in a subterranean formation having a laterally extending wellbore therein, the apparatus comprising:

an RF antenna configured to be positioned within the laterally extending wellbore;

at least one feedback conductor configured to be positioned along the laterally extending wellbore; and a radio frequency (RF) circuit supplying RF power to the hydrocarbon resources via said RF antenna;

said RF circuit supplying the RF power at a frequency tracking a resonant frequency of said RF antenna and said RF circuit and based upon said at least one feedback conductor.

2. The apparatus according to claim 1, wherein said RF circuit comprises an RF transmission line coupled to said RF antenna.

3. The apparatus according to claim 2, wherein said RF antenna comprises first and second spaced apart conductive sleeves extending within the laterally extending wellbore in end-to-end relation and defining an antenna feedpoint therebetween; and wherein said RF transmission line has a distal end coupled to the antenna feedpoint.

4. The apparatus according to claim 3, wherein said at least one feedback conductor comprises a pair of feedback conductors coupled together at distal ends thereof to define a feedback loop.

5. The apparatus according to claim 4, wherein the feedback loop is positioned adjacent the antenna feedpoint.

6. The apparatus according to claim 3, wherein said RF transmission line extends within said first conductive sleeve.

7. The apparatus according to claim 2, wherein said RF circuit comprises a power source and an RF amplifier coupled thereto.

8. The apparatus according to claim 7, wherein said RF amplifier comprises at least one output coupled to said transmission line and at least one input coupled to said at least one feedback conductor.

9. The apparatus according to claim 2, wherein said RF transmission line comprises a coaxial RF transmission line.

10. An apparatus for processing hydrocarbon resources in a subterranean formation having a laterally extending wellbore therein, the apparatus comprising:

an RF antenna configured to be positioned within the laterally extending wellbore;

a pair of feedback conductors configured to be positioned along the laterally extending wellbore and coupled together at distal ends thereof to define a feedback loop; and a radio frequency (RF) circuit comprising a transmission line coupled to said RF antenna and supplying RF power to the hydrocarbon resource via said RF antenna;

said RF circuit supplying the RF power at a frequency tracking a resonant frequency of said RF antenna and said RF circuit and based upon said feedback loop.

11. The apparatus according to claim 10, wherein said RF antenna comprises first and second spaced apart conductive sleeves extending within the laterally extending wellbore in end-to-end relation and defining an antenna feedpoint therebetween; and wherein said RF transmission line has a distal end coupled to the antenna feedpoint.

12. The apparatus according to claim 11, wherein the feedback loop is positioned adjacent the antenna feedpoint.

13. The apparatus according to claim 11, wherein said RF transmission line extends within said first conductive sleeve.

14. The apparatus according to claim 10, wherein said RF circuit comprises a power source and an RF amplifier coupled thereto.

15. The apparatus according to claim 14, wherein said RF amplifier comprises at least one output coupled to said transmission line and at least one input coupled to said feedback loop.

16. The apparatus according to claim 10, wherein said RF transmission line comprises a coaxial RF transmission line.

17. A method of processing hydrocarbon resources in a subterranean formation having a laterally extending wellbore therein, a radio frequency (RF) antenna positioned within the laterally extending wellbore, and at least one feedback conductor positioned along the laterally extending wellbore, the method comprising:

operating an RF circuit to supply RF power to the hydrocarbon resource via the RF antenna and to supply the RF power at a frequency tracking a resonant frequency of the RF antenna and the RF circuit and based upon the at least one feedback conductor.

18. The method according to claim 17, wherein the RF circuit comprises a transmission line coupled to the RF antenna.

19. The method according to claim 18, wherein operating the RF circuit comprises operating the RF circuit to supply RF power to the hydrocarbon resources via the RF antenna comprising first and second spaced apart conductive sleeves extending within the laterally extending wellbore in end-to-end relation and defining an antenna feedpoint therebetween coupled to a distal end of the RF transmission line.

20. The method according to claim 19, wherein operating the RF circuit comprises operating the RF circuit to supply RF power based upon a pair of feedback conductors coupled together at distal ends thereof to define a feedback loop.

21. The method according to claim 20, wherein operating the RF circuit comprises operating the RF circuit to supply RF power based upon the feedback loop positioned adjacent the antenna feedpoint.

22. The method according to claim 18, wherein operating the RF circuit comprises operating a power source and an RF amplifier coupled thereto.

23. The method according to claim 18, wherein operating the RF circuit to supply the RF power at a frequency tracking a resonant frequency of the RF antenna comprises operating the RF circuit to supply the RF power at a frequency tracking a fundamental resonant frequency of the RF antenna.

24. The method according to claim 18, wherein operating the RF circuit to supply the RF power at a frequency tracking a resonant frequency of the RF antenna comprises operating the RF circuit to supply the RF power at a frequency tracking a harmonic resonant frequency of the RF antenna.

* * * * *